US006161636A

United States Patent [19]

Osborne

[11] Patent Number: 6,161,636

[45] Date of Patent: Dec. 19, 2000

[54] BORING HEAD AND BIT PROTECTIVE COLLAR

[76] Inventor: Joseph D. Osborne, 4225 Thom, Columbiaville, Mich. 48421

[21] Appl. No.: 09/255,882

[22] Filed: Feb. 23, 1999

Related U.S. Application Data

[63] Continuation-in-part of application No. 09/211,326, Dec. 15, 1998.

[51] Int. Cl.[7] ..... E21B 10/00; E21B 7/26

[52] U.S. Cl. ..... 175/399; 175/19; 175/21; 175/73

[58] Field of Search ..... 175/19, 21, 61, 175/67, 73, 398, 399, 450, 435

[56] References Cited

U.S. PATENT DOCUMENTS

| | | | |
|---|---|---|---|
| 1,030,387 | 6/1912 | Critton . | |
| 1,893,033 | 1/1933 | Murdock et al. . | |
| 2,350,986 | 6/1944 | Collins | 175/400 X |
| 2,689,131 | 9/1954 | Priest . | |
| 3,668,877 | 6/1972 | Fuentas, Jr. . | |
| 4,993,503 | 2/1991 | Fischer et al. | 175/73 X |
| 5,020,608 | 6/1991 | Oden et al. . | |
| 5,148,880 | 9/1992 | Lee et al. | 175/398 X |
| 5,242,026 | 9/1993 | Deken et al. | 175/19 |
| 5,253,721 | 10/1993 | Lee | 175/73 |
| 5,341,887 | 8/1994 | Deken et al. | 175/62 |
| 5,695,014 | 12/1997 | Jenne | 175/21 |
| 5,794,719 | 8/1998 | Holloway . | |
| 5,899,283 | 5/1999 | Cox | 175/398 X |
| 5,941,322 | 8/1999 | Stephenson et al. | 175/61 |

OTHER PUBLICATIONS

Straightline Directional Drilling Systems, Straightline Model 2462, Straightline Manufacturing, Inc. Undated.

Ditch Witch® Jet TRAC® Directional Boring System Catalog of the Charles Machine Works, Inc. Perry, OK 73077, Undated.

Directional Depot Spring '98 Catalog of Directional Depot, La Miranda, CA 90637, Dated: Spring of 1998.

Directional Boring Accessories Catalog of Vermeer Manufacturing Co., Pella, Iowa 50219; dated: 1997.

*Primary Examiner*—Eileen D. Lillis
*Assistant Examiner*—Jong-Suk Lee
*Attorney, Agent, or Firm*—Young & Basile, PC

[57] ABSTRACT

A protective collar for a boring bit which interfaces with a boring head whereby shear forces developed during a boring operation are transmitted through the collar to the boring head, with minimal shear force being carried by mounting bolts. A collar is connected to a boring bit, wherein a head receptacle formed by the collar seatably receives a boring head with substantially close clearance so that shear forces during boring operations are transmitted from, the boring bit to the boring head through the collar. The preferred collar is fabricated from a pipe section, such as for example steel seamless pipe. In one embodiment, a bit recess is cut for interfacing with a boring bit at the head face connection thereof. A head recess is cut opposite the bit recess for providing an exit for the water spray from the nozzle thereof. In another embodiment, the collar has an inclined face with bores alignable with the bores in the boring head when the head is mounted within a receptacle in the collar. The boring bit is mountable on an inner interface surface with the bores in alignment for receiving threaded fasteners. In another embodiment, an opening is formed in the collar for receiving one end of the boring bit. When seated in the opening, the boring bit is engageable with the connection face of the head for receiving fasteners through a flange on the collar overlaying the end of the boring bit and the boring head.

9 Claims, 6 Drawing Sheets

BORING HEAD AND BIT PROTECTIVE COLLAR

CROSS REFERENCE TO CO-PENDING APPLICATION

This application is a continuation-in-part of co-pending application Ser. No. 09/211,326, filed Dec. 15, 1998 in the Joseph B. Osborne and entitled "Collared Boring Bit", the entire contents of which are incorporated herein by reference.

BACKGROUND OF THE INVENTION

1. Field of the Invention

The present invention relates to directional boring systems, and more particularly to the boring head to boring hit interface thereof.

2. Description of the Prior Art

Directional boring has become increasingly important for the installation of underground cables, such as for example electric, cable television, and telephone cables.

An example of a prior art directional boring system 10 is shown (in part) at FIGS. 1 and 2, wherein a spindle drive of a directional boring apparatus 12 serves to rotate and push drill pipe 14 into the ground G. As best shown at FIG. 2, at the end of the drill pipe 14 is a threadably mounted boring head 16 and a boring bit 18 connected to the boring head by bolts 20. The boring head 16 has a bit connection face 22 which has an acute angle A' with respect to the pipe axis P. The boring bit 18 may have various shapes for cutting into soil wherein a head connection face 24 is configured to restably mate with the bit connection face 22 of the boring head 16.

The drill pipe is hollow and is connected to a supply of high pressure water from the directional boring apparatus 12. The boring head 16 has an interior hollow which communicates with a hollow threaded shank 16*a* thereof. The boring head 16 further has a nozzle 26 through which the high pressure water from the directional boring apparatus 12 exits. The boring bit 16 is provided with carbide hard-facing 28 at the cutting edges for providing enhanced abrasion resistance during boring operations.

In operation of a directional boring system, the directional boring apparatus 12 forces the boring bit 18 into the ground G. The high pressure water serves to open the ground and help make way for the advancement of the boring bit and its associated boring head. The acute angle of the boring bit is adjusted relative to the ground (it is now not rotating) so that the boring head descends to a predetermined depth and then attains a horizontal attitude. The drill pipe 14 is now caused to rotate and with the advancement force supplied by the directional boring apparatus on the drill pipe, along with the high pressure water stream from the nozzle, the drill pipe advances underground along a predetermined path at the predetermined depth. More drill rods are added to assure sufficient drill pipe for the job, which can exceed a drill path length of 300 feet. When the end of the path is approaching, the drill pipe is again stopped from rotating and the acute angle of the boring bit is adjusted to cause further advancement to result in ascension until the boring head breaks ground. Now, a hook is installed on the boring bit and the directional boring apparatus now pulls back the drill pipe, wherein the cable is attached to the hook and is fed into the underground passage made by the drilling operation.

Thrust supplied by the directional boring apparatus can reach 17,000 pounds and the rotation speed of the boring bit can reach 200 revolutions per minute. Although the water flow rate out the nozzle can reach 700 pounds per square inch at a flow rate of up to 25 gallons per minute the boring bit is subjected to extreme shear force as it rotatively cuts into soils. When rocky, hard soils are encountered, such as glacial till soil, the boring bit can be subjected to shearing shock forces. Whatever the source, shearing forces tend to dislodge the boring bit from the boring head. Since only the bolts secure the boring bit to the boring head, these bolts must resist these shearing forces. No matter whether three, six, eight or more bolts are used, the bolts eventually will break, usually unpredictably, and always with great waste of time and expense for the directional boring system operator.

One attempt to address these problems has been devised in which a rectangular plate is bolted to the end of the drill pipe 14, with the opposite end of the plate overlaying and covering the bolts 20 used to secure the boring bit to the boring head. While this approach provides some protection for the bolts, the sides and surface of the boring head opposite from the plate as well as the sides of the boring bit remain exposed and are subject to abrasion and wear during drilling operation.

Accordingly, what remains needed in the art is an interface for a boring bit to a boring head, wherein shear force to the bolts is relieved and the boring head and the boring bit are protected from abrasion and wear during drilling operations.

SUMMARY OF THE INVENTION

The present invention is a protective collar for a boring head and bit which interfaces with a boring head whereby shear forces developed during a boring operation are transmitted between the boring head and the boring bit via a collar, with minimal shear force being carried by the bolts.

The boring bit according to the present invention has a ground cutting configuration of a selected geometry known in the art, as well as a conventional head connection face. In one embodiment, a bit collar is welded to the boring bit, wherein the bit collar and the head connection face of the boring bit collectively form a head receptacle for seatably receiving therein a boring head with substantially close, clearance (i.e., a snug mutual fit) so that shear forces during boring operations are transmitted through the collar between the boring bit and the boring head.

The preferred collar is fabricated from a pipe section, such as for example steel seamless pipe. A bit recess is cut for interfacing with a boring bit at the head face connection thereof. A head recess is cut opposite the bit recess for providing an exit for the water spray from the nozzle thereof. Both the bit recess and the head recess converge toward and communicate with a forward end of the pipe section, whereat, preferably, a brace is welded transversely to interconnect the remaining left and right pipe components (the rear end of the pipe remains fully intact) to thereby form the bit collar. It is preferred for carbide weld beads to be crisscrossingly placed upon the outer surface of the collar, as well as along the periphery of the head recess, to thereby add resistance to wear.

In operation, a boring bit is placed into the bit recess and welded to the collar. A boring head is then inserted through the rear end of the collar into the head receptacle until the bit connection face mates with the head connection face. The boring head is next bolted to the boring bit. Now the connected collar boring bit and boring head may be used to provide ground borings with a conventional directional boring apparatus.

In another aspect of the invention, the collar is separate from the boring bit and has an angled interface surface with bores alignable with the bores in the boring head when the boring head is snugly received in an interior receptacle formed in the collar. The boring bit is mountable on the interface surface of the collar, with the bores in the bit alignable with aligned bores in the collar and the head to receive threaded fasteners for securing the collar, the boring bit and the boring head into a unitary assembly.

In another aspect of the invention, the collar has an opening extending from a first end which is sized to receive an end of the boring bit, with the end of the boring bit sandwiched between opposed flanges formed on the first end of the collar. Bores in one flange of the collar are alignable with bores in the boring bit and the boring head and receive threaded fasteners for securing the collar, the boring bit and the boring head into a unitary assembly.

In these latter two embodiments, the collar encompasses substantially all of the boring head and a substantial portion of the boring bit to protect the boring head and the boring bit from abrasion and wear. The collar also functions to securely retain the boring bit on the boring head.

In addition, the protective collar of the present invention uniquely transmits shear forces between the boring bit and the boring head during a boring operation to minimize the possibility of separation of the boring bit from the boring head. The collar also minimizes shear stress on the bolts mounting the boring bit to the boring head.

DETAILED DESCRIPTION OF THE PREFERRED EMBODIMENTS

Referring now to FIGS. 3 through 10, the protective collar and boring bit 100 according to the present invention will be detailed.

Figure 1:
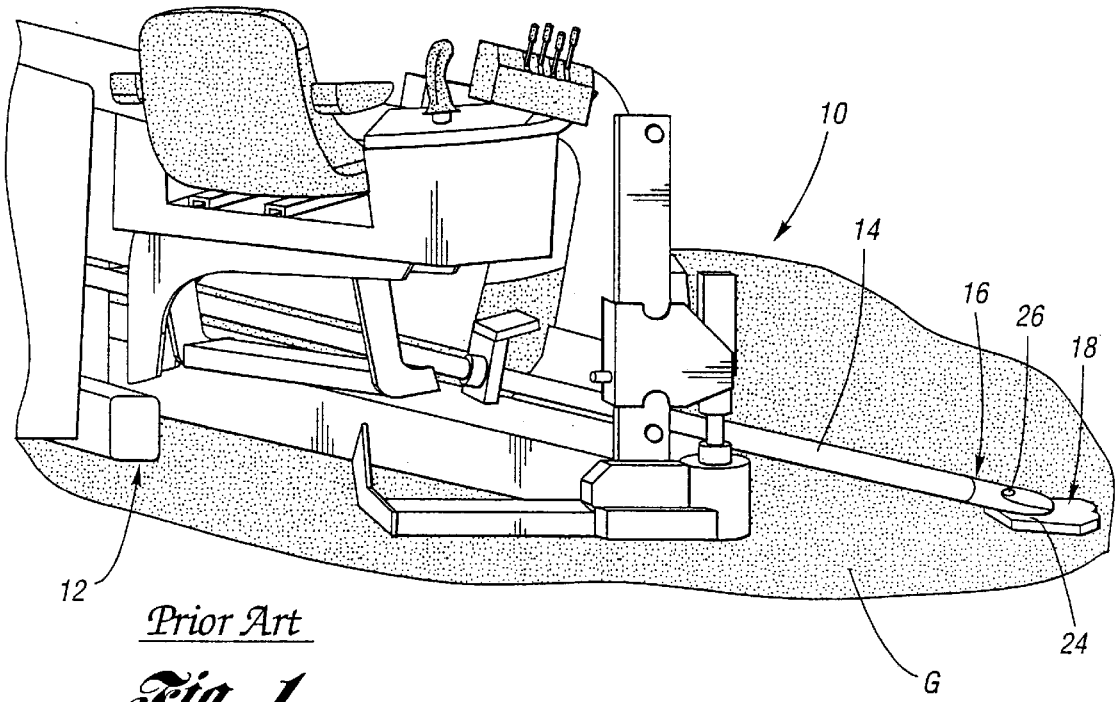
Prior Art Fig. 1
FIG. 1 is a broken-away, perspective view of a prior art directional boring system.
Figure 2:
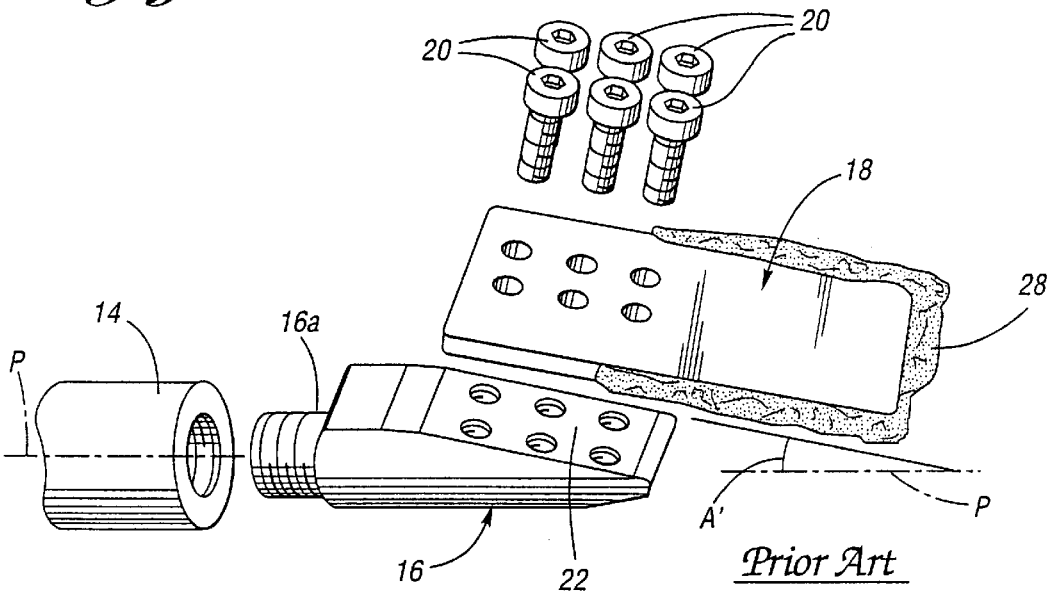
Prior Art Fig. 2
FIG. 2 is an exploded perspective view of a prior art boring head, boring bit and the bolts which serve as a threaded connection media therebetween.
Figure 3:
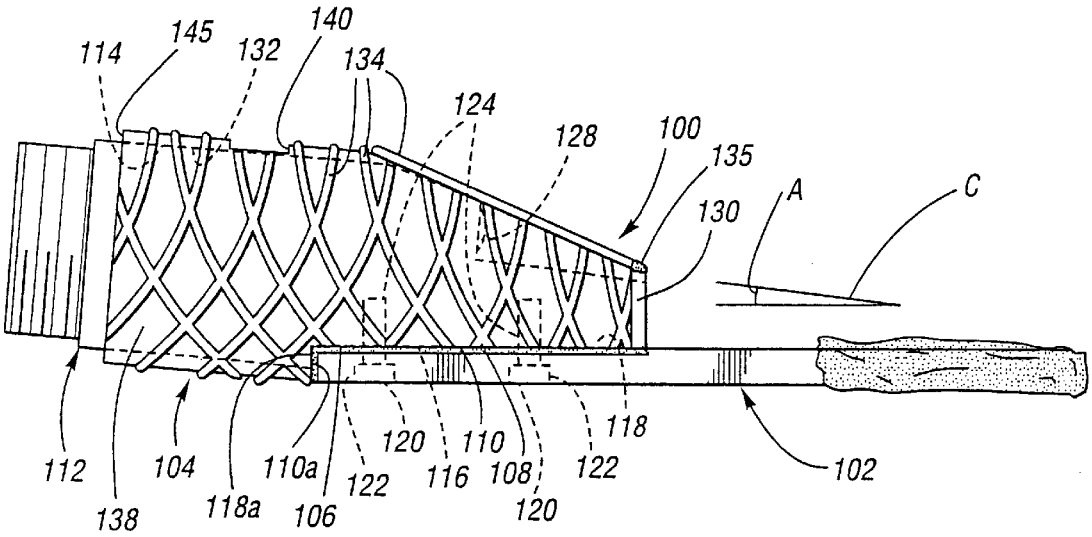
FIG. 3 is a side view of a protective collar and boring bit according to the present invention, shown in operation with a boring head.
Figure 4:
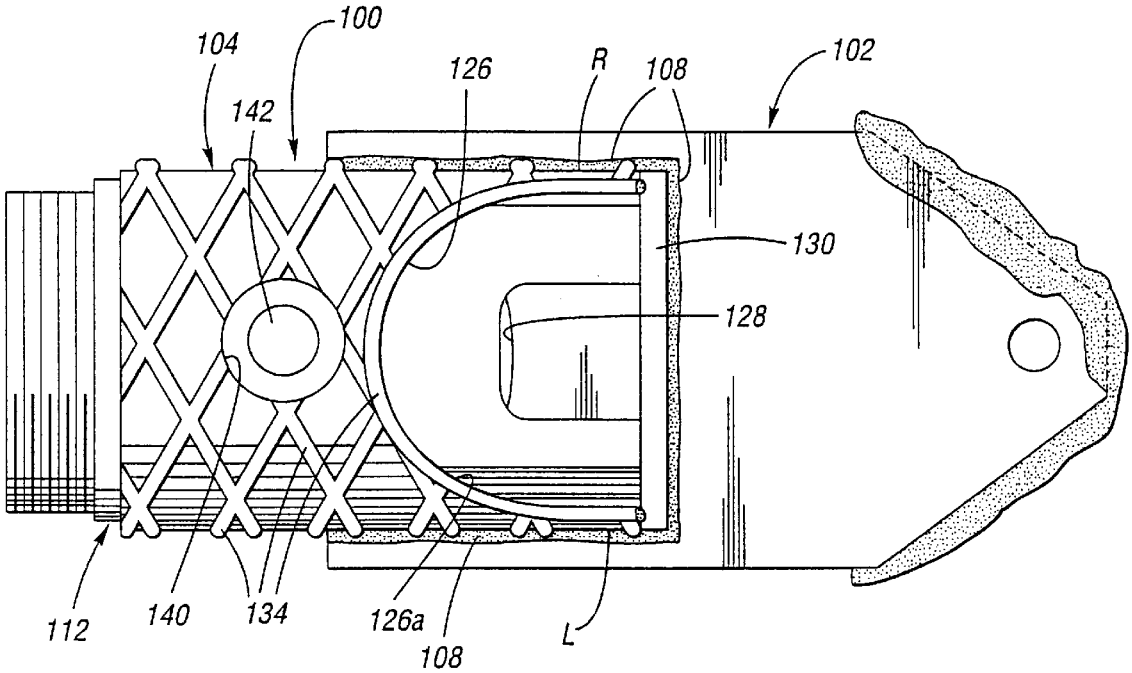
FIG. 4 is a top plan view of the collar boring bit and boring head of FIG. 3.
Figure 5:
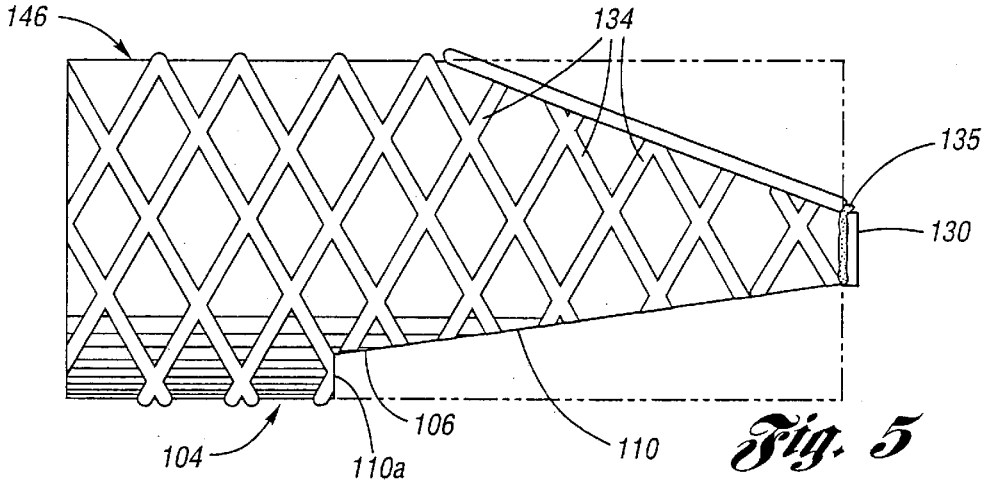
FIG. 5 is a side view of the collar according to the present invention.
Figure 6:
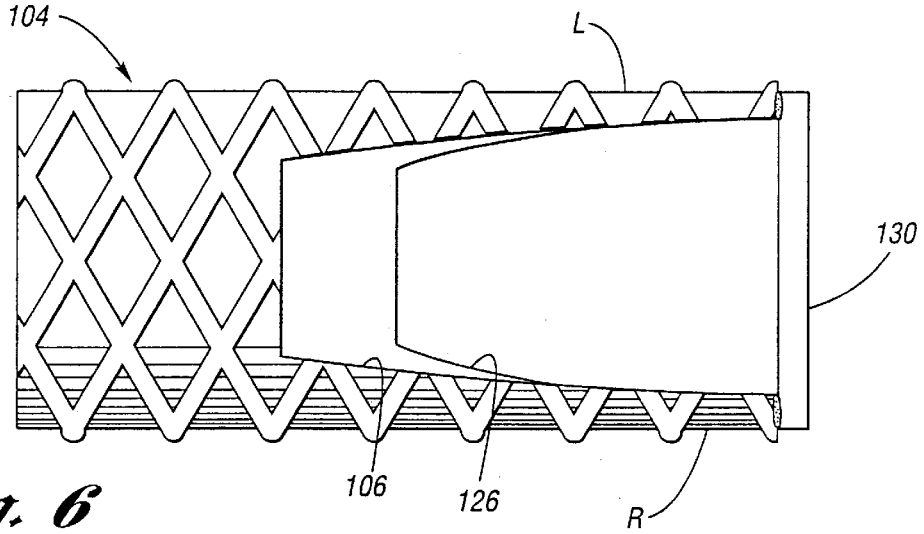
FIG. 6 is a bottom plan view of the collar of FIG. 5.
Figure 7:
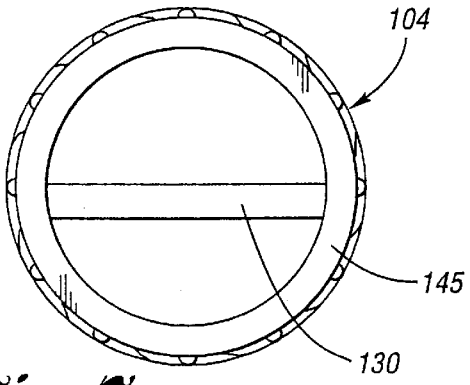
FIG. 7 is a rear end view of the collar of FIG. 5.
Figure 8:
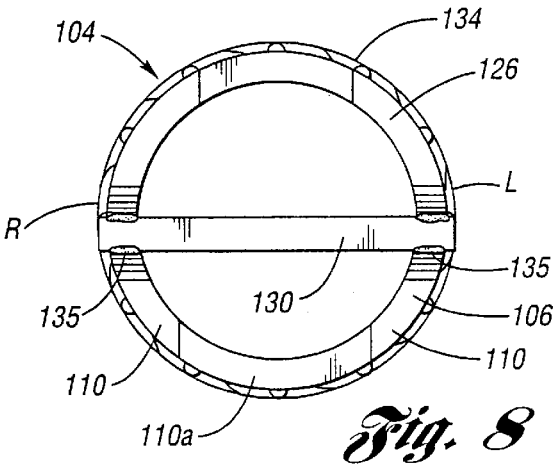
FIG. 8 is a forward end view of the collar of FIG. 5.

As shown at FIGS. 3 and 4, the protective collar and boring bit 100 includes a boring bit 102 and a collar 104 which is welded to the boring bit. In this regard, the collar 104 is provided with a bit recess 106 into which the boring bit 102 seats, and wherein the welding 108 is provided along the periphery 110 of the bit recess. The periphery 110 is cut at a predetermined acute angle A with respect to the collar axis C, wherein the angle A is selected to be equal to the acute angle of the bit connection face 116 of a boring head 112 (see for example FIG. 2). The terminus 110*a* of the periphery is located to abut the end 118*a* of the head connection face 118.

The collar 104 covers the head connection face 118 of the boring bit 102. The collar 104 and the head connection face 118 cooperate to form a head receptacle 114, wherein the boring head 112 snugly fits therein.

The boring head 112 is seatably received into the head receptacle 114 whereupon its bit connection face 116 interfaces conventionally with the head connection face 118 of the boring bit 102. Bolts 120 are used to affixedly secure the boring bit 102 to the boring head 112 via bolt holes 122 in the boring bit and aligned threaded holes 124 in the boring head.

The collar 104 further has a head recess 126 formed opposite the bit recess 106, wherein the nozzle 128 of the boring head 112 is fully exposed for the purpose of allowing water under pressure to spray therefrom without encumbrance.

Since the head recess 126 and the bit recess 106 converge toward, and communicate with, the forward end 135 of the collar 104, it is preferred for a brace 130 to transversely span the forward end, thereby serving to rigidify the forward end of the collar 104, as well, optionally, as serving to alignably abutment for the boring head 112 when it is inserted into the head receptacle 114. Welding 108 secures the brace 130 to the left and right components, L, R of the collar 104, as well as to the boring bit 102.

The interior wall surface 132 of the collar 104 is shaped to seatably receive the shape of the boring head with little play (snug fit) therebetween, as for example telescoping, generally cylindrical shapes.

It is preferred to provide a plurality of carbide weld beads 134. Upon the exterior surface 138 of the collar 104, as well as along the periphery 126*a* of the head recess 126. An example of placement of the carbide weld beads 134 is a crisscross pattern. The purpose of the carbide weld beads 134 is to provide the exterior surface 138 of the collar 104 with resistance to wear during drilling operations.

An aperture 140 may optionally be provided in the collar 104 so that a boring head equipped with a fusable plug 142 may operate without fetter. In this regard, if the nozzle 128 should become plugged, excessive heat opens the fusable plug 142 and allows water to flood therefrom so as to serve as a coolant and facilitate continued boring. The aperture 140 serves as a port through which this coolant water from the fusable plug 142 is able to freely pass out of the collar 104.

In operation, a collar 104 is fabricated (as for example according to the method described hereinbelow), and is welded to a boring bit 102 to thereby provide a protective collar and boring bit unit 100. A boring head 112 is placed into the rear end 145 of the collar 104, whereupon it is seatably received into the head receptacle 114 until bit connection face 116 of the boring head interfaces conventionally with the head connection face 118 of the boring bit 102. Bolts 120 are used to affixedly secure the boring bit 102 to the boring head 112 via bolt holes 122 in the boring bit and aligned threaded holes 124 in the boring head. Now, drill pipe is threadably engaged with the boring head and a directional boring apparatus is utilized to cause the boring bit to enter into the ground and provide a desired passage therethrough underground.

During operation of the directional boring apparatus, the drill pipe is caused to rotate, whereby the boring head transmits this rotation to the boring bit. As the boring bit cuts into various soils, resistance to this rotation develops. Accordingly, shear force between the boring bit and the boring head is present, which at times may be extreme enough to break the bolts if the collar was not present. However, the collar serves to transmit the shear forces between the boring head and the boring bit without breakage of the bolts. This is because the bit connection surface 116 of the boring head 112 is prevented from lifting away from the head connection surface 118 of the boring bit 102 by abutment of the boring head with interior wall surface 132 of the collar 104 due to the snug fit of the boring head in the head receptacle 114. Indeed, because of the snug interfit between the boring head 112 and the collar 104, the boring head will cause the boring bit 102 to rotate therewith even in the face of boring through glacial till soil even if no bolts are present.

Further, since boring heads are quite expensive, the bit collar will advantageously serve to protect the boring head from wear. Accordingly, the life of a boring head is now extended beyond the life a number of boring bits.

FIGS. 5 through 8 depict a preferred method of fabrication of the collar 104.

A pipe section 146 (shown in solid and dashed lines at FIG. 5), such as for example steel seamless pipe, is provided. The bit recess 110 is cut therein. The head recess 126 is cut therein opposite the bit recess. Both the bit recess and the head recess converge toward and communicate with the forward end of the pipe section (which is generally synonymous with the forward end 135 of the bit collar), whereat the brace 130 is welded transversely to interconnect the remaining left and right pipe components L, R, to thereby form the collar 104. An arc or gas welding unit is then utilized to place the carbide weld beads 134 crisscrossingly onto the outer surface of the bit collar, as well as along the periphery of the head recess, to thereby add resistance to wear.

Figure 9:
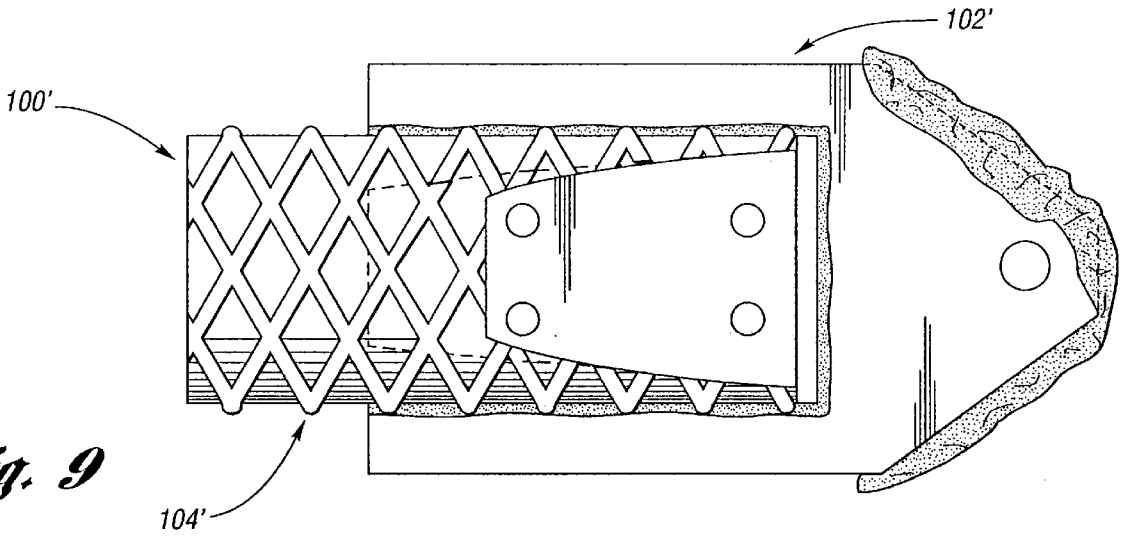
FIGS. 9 and 10 depict top plan views of exemplary collared boring bits according to the present invention.
Figure 10:
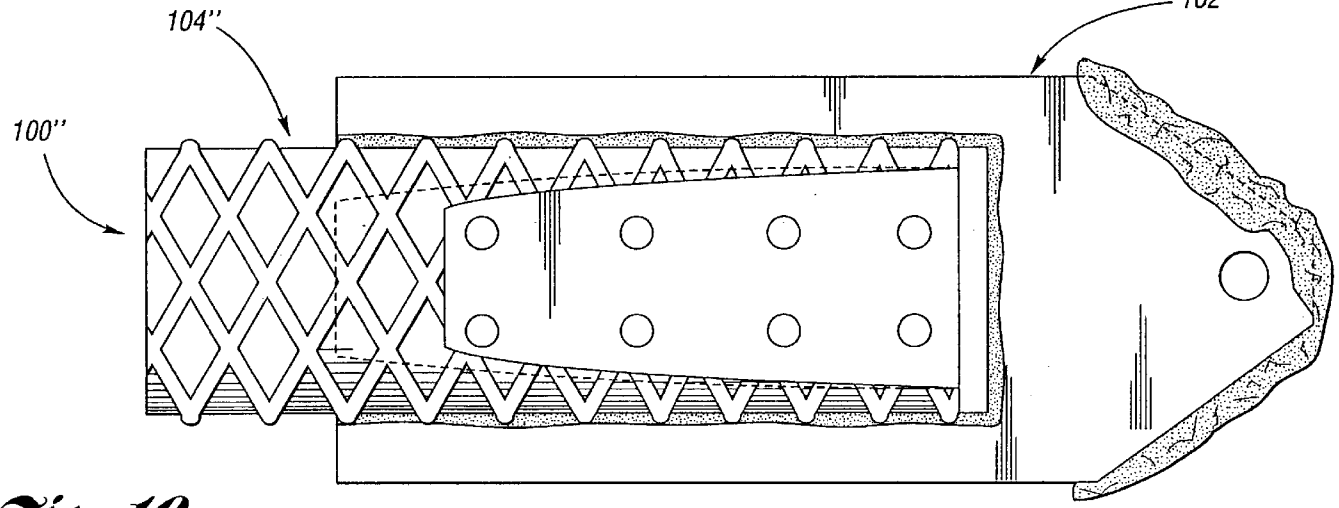

FIGS. 9 and 10 demonstrate possible configurations of the boring bit 102', 102", and the collar 104', 104", of respectively differingly sized collared boring bits 100', 100", which respectively accommodate differingly elongated boring heads.

Figure 11:
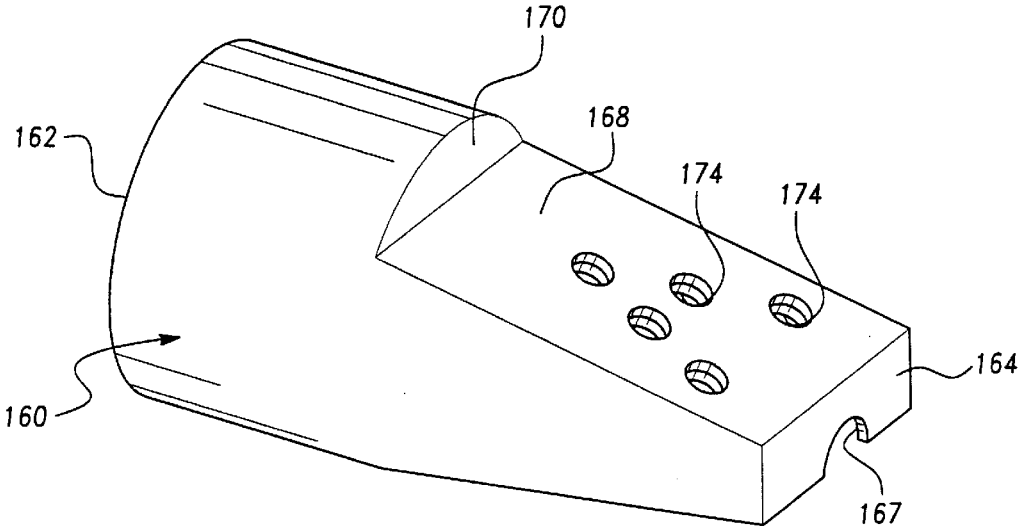
FIG. 11 is a perspective view of a protective collar according to another embodiment of the present invention.
Figure 12:
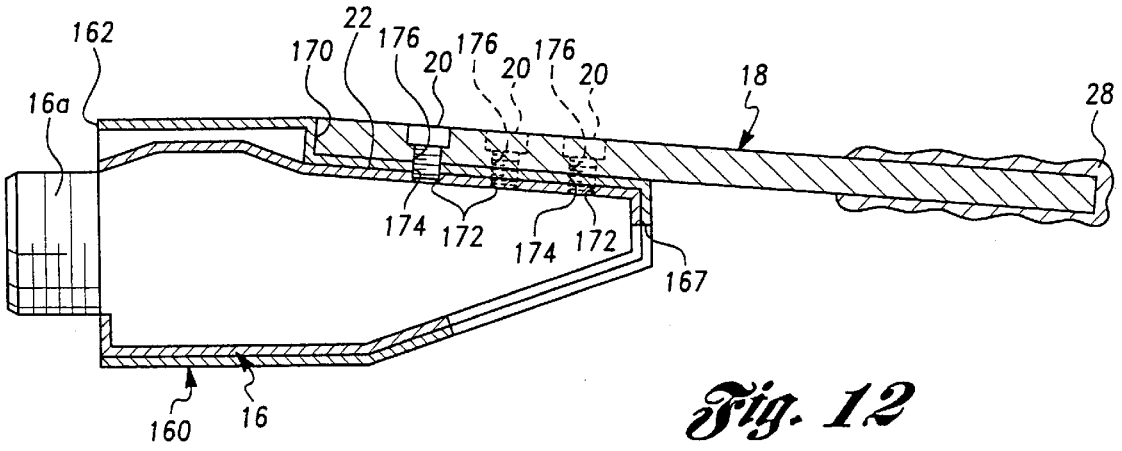
FIG. 12 is a longitudinal, cross-sectional view through the collar shown in FIG. 10, with the boring head and boring bit mounted thereon.

Referring now to FIGS. 11 and 12, there is depicted another embodiment of a collar 160 according to the present invention. The collar 160 is in the form of a generally cylindrical or tubular body having a completely closed sidewall between a first end 162 and an opposed second end 164. The first end 162 is open to enable the boring head 16 to be inserted into the hollow interior of the collar 160. The hollow interior of the collar 160 is shaped as a receptacle for receiving the head 16 in registry or in a snug fit. One end portion 166 of the collar 160 adjacent the second end 164 tapers from the larger diameter first end 162 to the smaller cross section second end 164.

A connection or interface surface 168 is formed on the collar 160 and extends at an acute angle from the second end 164 with respect to a longitudinal axis through the collar 160. The connection interface surface 168 is at the same acute angle as is the connection face 22 of the boring head 16 as described above. The interface surface 168 terminates in an angularly projecting wall 170. The wall 170 acts as a seat for one end of the boring bit 18.

An aperture 167 is formed in the inclined surface and is alignable with the nozzle or outlet in the boring head 16, as described above, to allow for the discharge of water from the boring head 16 through the collar 160.

As is conventional, and as described above, bores 172 in the boring head 16 are threaded to receive a threaded fastener, such as a bolt 20. Further, the bores 172 are arranged in a predetermined pattern and number consistent with the overall size and shape of the boring head. Six bores 172 are depicted by way of example only in the boring head 16. It should also be noted that the bore pattern in the embodiments shown in FIGS. 11 and 12 differs slightly from the bore pattern shown in the prior art FIGS. 1 and 2 and FIGS. 9 and 10 of the previous embodiments of the present collar.

The collar 160 also has a plurality of bores 174 which are arranged in the same pattern and number as the bores 172 in the head 16. The boring bit 28 also has a plurality of bores 176 which are arranged in a like number and pattern as the bores 174 and 172. The bores 174 and 176 in the collar 160 and bit 18, respectively, are smooth sided. Further, the bores in the bit 18 are countersunk, as shown in FIG. 12, for receiving the enlarged head of the bolts 20 to dispose the outer end of the bolts 20 substantially flush with the outer surface of the bit 18.

In use, the collar 160 is mounted over the head 16 in a snug, conforming bit. The bit 18 is then mounted on the interface surface 168 of the collar 160, with the bores 176 in the bit 18 aligned with the bores 174 in the collar 160 and the bores 172 in the head 16. The bolts 20 are then inserted through the bores 176 and 174 and threaded into tight engagement with the threaded bores 172 in the head 16 to securely affix the bit 18 to the collar 160 and, also, the bit 18 and the collar 160 to the head 16. However, since bolts 20 are employed, the bit 18 may be easily removed from the collar 160 for replacement, repair, etc. Further, the collar 160 may be removed from the head 16, also for repair or replacement. However, during use, the collar 160 uniquely encompasses substantially all of the head 16 and extends laterally at least as wide as the side edges of the bit 18 to provide abrasion resistance for head 16 and the bit 18.

Figure 13:
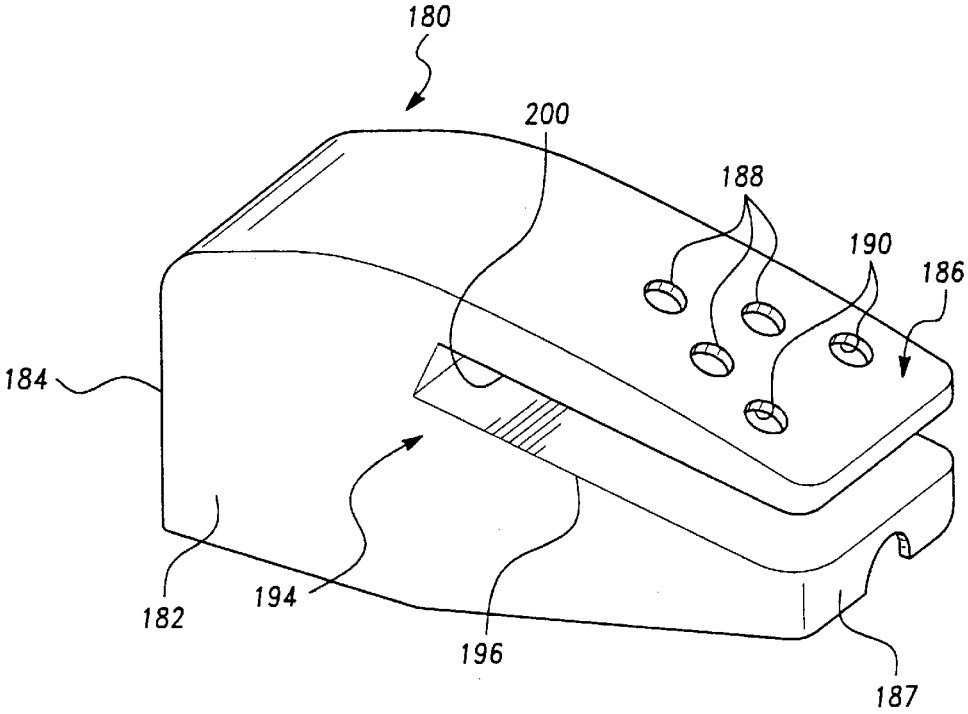
FIG. 13 is a perspective view of another embodiment of a protective collar according to the present invention.
Figure 14:
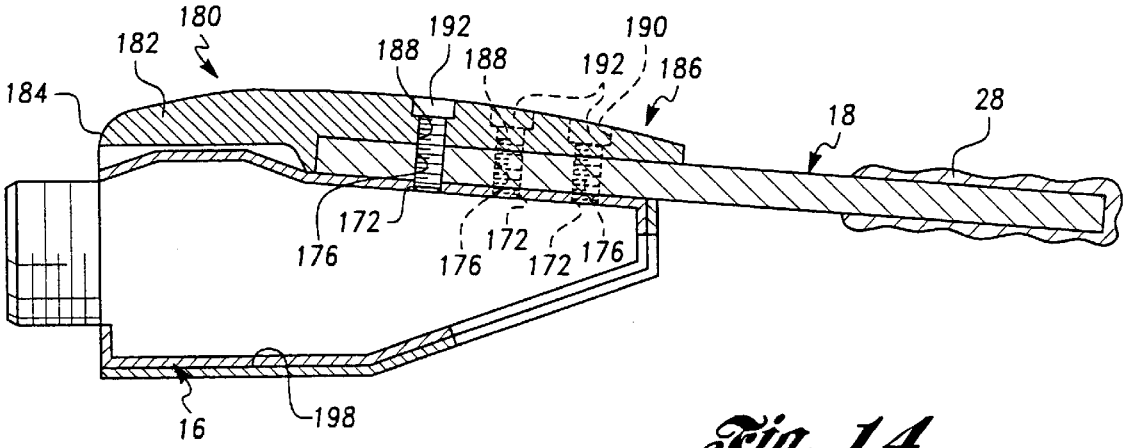
FIG. 14 is a longitudinal, cross-sectional view of the collar of FIG. 12, with the boring bit and boring head mounted therein.

FIGS. 13 and 14 depict yet another embodiment of a collar 180 which is also adapted for protecting substantially all of the exterior surface of head 16 as well as a substantial portion of the bit 18. In this embodiment, the collar 180 also is formed with a generally cylindrical or tubular first portion 182 extending from a first, open end 184. The open end 184 communicates with a hollow interior cavity within the collar 180 which is sized and shaped to form a receptacle which snugly receives the boring head 16 as described hereafter and shown in FIG. 14.

A first flange 186 projects from the first portion 182 of the collar 180. The first flange 186 preferably has a planar configuration and is formed at an acute angle with respect to a longitudinal axis extending between opposed first and second ends 184 and 187 of the collar 180 for conformity with the acute angle of connection base 22 of the head 16.

A plurality of bores 188 and 190 are formed through the first flange 186. The bores 188 and 190 are provided in a predetermined number and in a predetermined pattern conforming to the number and arrangement of the bores 172 in the head 16. The bores 188 are countersunk for receiving bolts 192, as shown in FIG. 14 in a substantially flush arrangement with the exterior surface of the first flange 186. The bores 190 are straight through bores sized to receive the enlarged head of the bolts 192.

A second flange 194 projects from the cylindrical end portion 182 of the collar 180. The second flange 194 is generally cup-shaped with opposed, raised sidewalls 196 which project upwardly from a bottom wall 198. The sidewalls 196 form an opening which communicates with the hollow receptacle formed in the end portion 182 of the collar 180 and is shaped to receive the end portion of the head 16 as shown in FIG. 14. The upper edges of the sidewalls 196 of the second flange 194 and an inner connection surface 200 on the first flange 186 are spaced apart at a distance to snugly receive one end of the boring bit 18. The bores 176 are formed in the bit 18 in the same number and arrangement as the bores 188, 190 and 172 in the first flange 186 and the head 16, respectively. The bolts 192 are then inserted through the aligned bores 190, 176 and 172, with the threaded shanks of the bolts 172 threaded into the threaded bores 172 in the head 16 to securely interconnect the bit 18 to the head 16 as well as to fixedly, yet removably mount the collar 180 to the bit 18 and to the head 16.

The collar 180 shown in FIGS. 13 and 14 encompasses all of the head 16 in the same manner as the collar 160 shown in FIGS. 11 and 12. Further, the first flange 186 overlays an end portion of the bit 18 thereby providing a protective surface over the end portion of the bit 18. The collar 180 thus serves to protect the head 16 and at least the end portion of the bit 18 from abrasion during boring operations.

What is claimed is:

1. A protective apparatus for use with a boring head of a directional boring apparatus having a bit connection face and a boring bit having a connection face, the protective apparatus comprising:

a collar having an interface surface with a first plurality of apertures and a hollow interior receiving the boring head; and a second plurality of apertures formed in a connection face of the boring bit, the second plurality of apertures in the connection face being alignable with the first plurality of apertures in the interface surface of the collar and a third plurality of apertures in the bit connection face of the boring head and receiving a plurality of threaded fasteners for joining the boring head, the boring bit and the collar into a unitary structure.

2. The protective apparatus of claim 1 wherein the collar is formed of a body having a sidewall substantially encircling an end portion of the boring head mounted therein.

3. The protective apparatus of claim 1 wherein:

the interface surface of the collar is disposed at a predetermined acute angle with respect to a longitudinal axis extending between opposed ends of the collar for engagement with the connection face of the boring bit.

4. The protective apparatus of the claim 1 wherein:

the interface surface of the collar is interposed between the connection face of the boring bit and the bit connection face of the boring head.

5. The protective apparatus of claim 4 further comprising:

a seat formed on the collar at one end of the interface surface, the seat engagable with one end of the boring bit.

6. The protective apparatus of claim 1 wherein:

the interface surface of the collar is exteriorly located with respect to the boring head and the boring bit coupled thereto.

7. The protective apparatus of claim 6 further comprising:

an opening extending from one end of the collar, the opening receiving one end of the boring head.

8. The protective apparatus of claim 7 wherein:

the opening communicates with the interior of the collar wherein the boring head is mountable in the collar placing the second plurality of apertures in the bit connection face of the boring head, and the first plurality of apertures in the interface surface of the collar in alignment for receiving the plurality of fasteners therethrough.

9. The protective apparatus of claim 7 wherein:

the interface surface of the collar is disposed at a predetermined acute angle with respect to a longitudinal axis extending between opposed ends of the collar for engagement with the connection face of the boring bit.

* * * * *